US005894895A

United States Patent [19]

Welsh

[11] Patent Number: 5,894,895

[45] Date of Patent: Apr. 20, 1999

[54] HEAVE COMPENSATOR FOR DRILL SHIPS

[76] Inventor: Walter Thomas Welsh, 510 Farmington Dr., Lafayette, La. 70503

[21] Appl. No.: 08/755,186

[22] Filed: Nov. 25, 1996

[51] Int. Cl.[6] ..... B66D 1/48; E21B 19/09

[52] U.S. Cl. ..... 175/5; 175/40; 254/277; 254/900

[58] Field of Search ..... 254/277, 337, 254/900; 175/5, 40; 166/355

[56] References Cited

U.S. PATENT DOCUMENTS

| | | | |
|---|---|---|---|
| Re. 29,565 | 3/1978 | Hawley et al. | 254/399 |
| 3,653,635 | 4/1972 | Bates, Jr. et al. | 175/5 X |
| 3,653,636 | 4/1972 | Burrell | 175/5 X |
| 3,743,249 | 7/1973 | Van Daalen | 254/273 |
| 3,871,622 | 3/1975 | Larralde et al. | 175/5 X |
| 4,098,491 | 7/1978 | Larralde | 254/900 X |
| 4,576,517 | 3/1986 | McCann et al. | 405/195.1 |
| 4,852,052 | 7/1989 | Frey et al. | 175/40 X |

*Primary Examiner*—David J. Bagnell
*Attorney, Agent, or Firm*—John D. Jeter

[57] ABSTRACT

A heave compensator for a drill ship with a derrick and hoist system with a dead line provides a line reservoir on the dead line. The dead line is reciprocated to move the hook load relative to the vessel to control it relative to the sea bed. The line reservoir is expanded or contracted by changes in ballast pressure to counterbalance the hook load. To compensate for heave and friction in the hoist system a pressure source is provided to augment the ballast pressure for hook load and position control. Sensors and controls are provided to anticipate and compensate for oncoming heave excursions. The dead line being flexible permits latitude in selecting and orienting the compensator machinery. As an option, the vertical movement sensor is placed on the hook related structure for more responsiveness to hook load movements.

23 Claims, 2 Drawing Sheets

HEAVE COMPENSATOR FOR DRILL SHIPS

This invention pertains to a heave compensating system for use in well related activities from floating drill ships and the like that rise and fall with changing level of the supporting water body. More specifically, the system maintains a uniform hook load, or earth related vertical hook position, by way of cable supported hoisting machinery during rise and fall of the floating structure. The system is inherently capable of supporting a rig suspended hook load vertically stationary relative to a selected sea bed plane.

BACKGROUND OF THE INVENTION

Offshore drilling from floating structures expanded and became commonplace after world war II but the industry has never fully solved the problem caused by rise and fall of the floating structure. The drill ship normally has a derrick above the vessels deck from which a hoist hook suspends most well related payloads. A load suspended from the hook will rise and fall, in sympathy with the heave of the vessel, relative to the sea bed or the bottom of a well. Common rise and fall may be on the order of ten feet. If not compensated for vessel heave, a suspended load may bash sea bed structures and a drill string may damage a drill bit by extreme load variations. The traditional remedy for problems caused by vessel heave has been to suspend operations until the cause of the excess heave subsides. Such suspensions are costly and endanger the well bore.

A vast majority of drilling rigs, sea borne or on land, use a generally common main load handling system. A live cable drum is powered, called the draw works, to drive a wire line extending to a crown block atop the derrick and down to a traveling block, which carries the hook, that moves between the top and bottom of the available travel space. The wire line is reversed about the traveling block by a sheave and returns to the crown block. There is a plurality of sheaves rigged side by side on both the crown and traveling blocks and the wire line makes about six loops about the sets of separated sheaves. The final wrap around the crown block leaves an immobile line, called the dead line, that extends down to the derrick floor where it is clamped off.

Contributing to the bit load control problem is the draw works design feature that provides one operational mode for line payout and another mode for reeling in line. The mode cannot be easily changed while uniform drilling proceeds. Efforts to change that feature have not resulted in significant changes in draw works design. The draw works cannot readily pay out line and immediately take in line. Vessel heave then provides a form of movement that is not within the draw works capability to compensate.

The natural characteristics of water body dynamics pose both problems and potential solutions. Water bodies subject floating structures to three principal forms of surface chance features; wind waves, swells, and tides. During the usual operational weather wind waves are too small to significantly influence large drilling related vessels. Tides are usually so gradual as to fall well within the rate change abilities of automatic drillers. Significant disturbances due to tides are so predictable that simple preparations for the events are possible. Swells cause most heave problems.

Swells individually approach the shape of sine waves and have a cyclic regularity and their amplitude and frequency usually change slowly. Any selected site may be approached by more than one swell system and they usually arrive from different directions. A vessel, then, may be reacting to the resultant coincidence of several swell systems. The vessel rise and fall excursions will usually define a repeated series of events with a repetition pattern, called the period, of only a few minutes. It should be acknowledged that there are locations and conditions, fortunately rare, that can only be described as chaotic in terms of swell behavior. That rare existence should have little impact upon the need presently addressed.

The hook needs two forms of stabilization. First, stabilization is needed to handle risers that extend from sea bed installations, which must be attached to and removed from the installation while suspended from a heaving vessel. That use demands a stable hook relationship to the sea bed during vessel heave and whether or not the load changes. Second, stabilization is needed to handle drill strings that move downward relative to the sea bed while drilling. The bit load needs stabilization during planned downward movement and during vessel response to heave, and bit load may be less than ten percent of the hook load. While drilling, the degree of control can be somewhat relaxed to cut wear and tear. Further, if it is known that no heavy sea is imminent, only part of the compensator capability needs to be kept active.

Efforts to cope with the heave problems have produced two principal forms of compensating apparatus. One form is carried by the traveling block and comprises a power cylinder arrangement with pressure ballast to provide force to equal hook load. The traveling compensator system works but adds to the ton miles of work done by the draw works. A second compensator concept comprises a ballasted support for the crown block which moves it vertically relative to the derrick and allows it to maintain a practically uniform distance between crown block and sea bed. The draw works is mounted on and moving with the heaving vessel and complicates the situation. The greatest drawback, however, is the added structural mass high in the derrick. More is required of a vessel for it to remain within stability limits with the extra weight aloft.

The technical burden of the currently available compensator systems is constant whether they are active or passive, in terms of the dead weight present far above the vessel metacentric height.

There are compatibility problems. When hook load changes are made the vessel changes elevation. Sensors respond to changes and direct controls to make adjustments, which sets off another round of reactions. Two massive systems may be changing and interacting at the same time to different individual natural frequencies. A powered oscillation may be induced that can be destructive and dangerous. As a minimum the compensator system may often be rendered useless.

Some hook loads such as riser assemblies represent payloads greater than currently available heave compensating systems can support. The risers have attached buoyancy features that reduce the weight in water to an amount within the range of the heave compensator rating,. In the presence of heave, however, the acceleration forces are related to inertia, related to the total structural weight of the riser and attached features, regardless of buoyancy provided. The compensator is either nearly perfect in terms of holding the payload static or its rating may be briefly exceeded. Without almost total compensation for heave, handling risers in the vicinity of seabed installations such as well heads presents unacceptable hazards unless near calm conditions prevail.

If full hook load capacity is compensated the related machine and structure weight can be substantial and it can influence vessel behavior. Both location of such machinery and the effect of its actuation has to be considered. It is desirable to place heavy machinery below the vessels metacentric height and available designs do not invite that option. Sudden movement of heavy machine components can result in proportional response of the vessel, which sensors detect, and to which automatic compensators respond to produce further reaction, and a possibly unfortunate feedback loop is established unless there is substantial freedom of choice of location of compensator machinery relative to the vessel.

The search for compensation improvement does not suffer from a shortage of sensor and signal processor availability. Such systems are often called inertial platforms. There are several movement sensor systems available that are quite precise and responsive. They commonly have outputs indicative of acceleration, speed, and distance moved from a reference. The aerospace and defense industries have exceeded the requirements of the drilling environment with proven reliable systems. Outputs from the sensor related signal processor systems can be matched to the controls required to fully deploy the compensators needed. Hydraulic controls are available to satisfy any foreseen need.

Some definitions are in order, primarily dealing with sensors, transducers, and related signal processors. Accelerometers now available can endure the shock related to any anticipated location if they are properly mounted and protected. Processors related to micro computers have no problem delivering velocity and distance moved from a selected reference after a selected time reference. From processors, signals can be directly tailored to drive any control device foreseeable to serve the purpose of the present invention. Feedback devices are sometimes essential to indicate what the controlled system is doing after signals to go into action have been delivered. Safety considerations will dictate use of feedback detector devices to compare evolving actions relative to directions for actions. Such contrivances are in the art and are shown, at least symbolically in this disclosure without details of construction. Of the several sensor and transducer options presented herein, all direct signals to a central processor. This does not preclude distributing the various circuitry sub assemblies among the several defined components.

It is therefore an object of this invention to provide a heave compensation system for a drill ship that will function in the worst expectable sea conditions with machinery that can be altered functionally to involve only the amount of compensation effort that conditions and load demands permit.

It is another object of this invention to provide heave compensation apparatus that provides only the contrivances necessary to utilize existing sensors, sensor signal processors, fluid controls that respond to the sensors to manage the apparatus and to provide means to select combinations of available components to economize the operation for general purpose service.

It is yet another object of this invention to provide a variable capacity wire line storage means, or line reservoir, to operate on the dead line to reciprocate the dead line to influence the position and movement of the traveling block in response to processed signals from movement sensors.

It is still another object of this invention to provide information from periodic heave experience of a vessel to anticipate heave excursions during the next period of vessel movement and to use that anticipated information to avoid hysteresis effects and to move the hook as needed to maintain the hook in a preselected relationship with the earth.

It is yet another object of this invention to use anticipated direction of oncoming heave movement and provide enough power to overcome at least most of the resistance of the hoist related machinery to move in the oncoming direction of motion so that load counterbalance will suffice for compensation in more circumstances.

It is yet another object of this invention to provide heave compensation apparatus that senses movement from the traveling block to compensate for vessel movement and the sum of strain dimensions of the vessel and the related derrick and hoist structures.

It is still another object of this invention to use the dead line for means to locate compensator machinery low in the ship for stability and to orient apparatus such that the movement is least disruptive to the drill ship activity and vessel stability.

It is yet another object of this invention to provide divided line reservoir apparatus so that a sensitive minor portion can be operated to avoid excessive operation of the major component and to provide finer incremental control of load management when needed.

These and other objects, advantages, and features of this invention will be apparent to those skilled in the art from a consideration of this specification, including the attached claims and appended drawings.

SUMMARY OF THE INVENTION

The heave compensator system operates on the dead line of a drilling rig on floating structure with a derrick and major hoist system having a draw works, live wire line, crown block, traveling block, and a dead wire line. The compensator reciprocates the dead line to control limited vertical movement of the traveling block having a hook from which the load is suspended. To reciprocate the dead line, a line reservoir is provided somewhat resembling the multiple sheave sets of the crown and traveling block combination and their related multiple loops of wire line. The reservoir has two sets of sheaves variably spaced apart with the separation forced by a power cylinder. The dead line is wrapped a number of turns about the opposed sheaves and secured to the vessel such that change in the separation between sets of sheaves runs a length of tensioned line in or out in the direction of the crown block as needed to influence the vertical position of the hook. That vertical position is dictated by output signals from sensors and related processors. The hook is held generally stationary relative to the earth during heaving movement of the vessel.

The cylinders that space the sheaves will produce total force approximating the hook load plus the traveling block weight. Ballast pressure is provided by compressible fluid acting over liquid that is vented to the cylinders. Long term ballast changes are made by changing the gas pressure. The basic counterbalance portion of the compensator is thus described. The counterbalance does not overcome its own running friction, or inertia, but the load can be held stationary relative to earth by any available means, such as anchoring it to some earth related structure or the sea bed. The heaving vessel will exercise the line storage system, requiring force from some source in the process. Such possibilities are anticipated by and are within scope of the claims.

The counterbalance provided by ballast pressure and power cylinders is a salient factor in all operational modes of the disclosed compensator. Augmentation of ballast pressure is usually necessary to prevent vessel heave from influencing the load. The degree of compensation depends upon the nature of the intended relationship between the controlling device, its signals, and their intended effect upon the payload to be protected from vessel heave.

It is preferred to control the hook position without dependence upon anything not fully under the operators control and that purpose is satisfied by adding controls to the basic counterbalance system just described. Short term changes in delivered ballast pressure are made by pumps that operate in either direction in the ballast tank to cylinder feed manifold. The pump outputs are responsive to fast controls in response to sensor related signals to yield the pressure differential between tank and cylinders that is required for counterbalance in the dynamic situation. Centrifugal pumps are preferred because they are most reliable, can be harmlessly valved closed, and modern motor speed controls enable smooth pump pressure output controls.

A compensator system that will serve in all conditions unnecessarily taxes the overall hoist system when only minor swells are active. A general purpose compensator system is addressed by rendering the mechanism responsive to a range of sensor and signal processor output signals. Sensor and processor architecture is not part of this invention but their arrangement options drive formulation of points of novelty in the balance of the compensator. That necessary relationship is contemplated by and is within the scope of the claims.

The hook load, and the traveling block, can be counterbalanced by pressure in the ballast tank. In many cases the resulting lag of heave compensation is of no consequence to the operation underway. This is the most economical operation mode available.

To simply counterbalance the load and provide line running power to approximate friction losses that result from movement of the hook load relative to the vessel, the sensor signal is digital and indicates the direction of impending vessel movement. In essence, once movement in one direction stops, the signal reverses the controls. Augmentation then urges movement of lines and sheaves in the direction indicated. Ballast augmentation needed to overcome friction can be easily determined experimentally. Pressure needed to overcome friction is provided by a centrifugal pump in the ballast tank to cylinder duct, oriented in direction by the sensor signal. Friction and the pressure needed to overcome it should remain about constant for a given hook load. The resulting degree of compensation is less than perfect and it is not preferred when conditions cause heave movement to pause before continuing in the same direction. When it serves the purpose, this selectable mode places the least burden on the activity served by an active system.

When the most exacting control is required, an inertial platform is mounted on the traveling block and produces output error signals related to a selected earth related horizontal plane. That choice removes the uncertainty of derrick and vessel strain. Those strains too are compensated. The inertial platform only needs to read the vertical axis. Such platforms usually produce three error signals of interest, acceleration, its time based integral representing velocity, and the second time related integral representing displacement. The platform processor delivers an error signal to which the compensator responds. The sought result is to cause the compensator to return all three signals to the nulled zero. The common program produces signals to stop the acceleration, then the achieved velocity, then return the achieved displacement to zero.

Considering now the mode of compensator operation to cooperate with the platform, the ballast and cylinder arrangement requires fast and powerful energy supplement. The power cylinders are fully vented to the ballast tanks and they counterbalance the hook load. Smaller double acting cylinders, actuation cylinders, act to control separation of the sheave sets to feed tension line as required by the signals. Controls, pumps, and source tanks for this function are kept small. Suitable off the shelf components are available.

Vessel heave can be measured by accelerometer based sensors or it can be measured directly by running a tension wire between the vessel and the sea bed, or structure secured to the sea bed. The tension wire will operate a transducer that supplies the signal needed by the compensator. From vessel position information, simple signal processors can determine the amount of dead line feed needed to move the hook an amount relative to the vessel to keep the hook a selected distance from the sea bed reference. The compensation by this process requires no change in the compensator structure. The ballast augmentation will not be constant and fluid pressure and volume provided by pumps will experience considerable change of rates. Inertia to be overcome is in the compensator system because the traveling block and hook load will, ideally, not move relative to earth. It is not desirable, however, to run tension lines generally exposed in water bodies if considerable force and power may be influenced by chance fouling of such lines. The system will surely be available for emergency situations.

In gentle seas there is a reluctance to continually operate the large number of sheaves of the line storage system on short strokes. Wire lines will wear locally and cause weak spots. An optional vernier line feeder is provided parallel to the main line feeder with a power cylinder separating a pair of single line sheaves. The vernier cylinder makes long strokes and feeds only two feet of line for each foot of stroke but the line wear is spread over more distance.

For more severe stability requirements in terms of maintaining the traveling block a fixed distance from the sea bed regardless of vessel heave and moderate hook load changes, the vernier feed provides a source of fast response. The major line feeder then derives at least part of its direction, by way of cooperating signal processors, from the position of the vernier feeder. That arrangement prevents the vernier feeder from being out of stroke when it is needed to compensate for hysteresis in the main feeder. The vernier feeder is much smaller than the main feeder and it can be quite separate, disposed optionally along the dead line, and may be operated by a separate hydraulic power source.

An option relates to features added to the usual sensor system in that each periodic set of heave excursions is recorded on a tape loop by a write head. An adjustable time delay read back head is provided. The signals read are the input to a variable amplifier, the output of which provides a supplemental control signal input to the line feeder controls. The variable delay and variable signal strength output permits tuning the overall system to anticipate oncoming heave actions and to put the major feeder machinery into at least muted movement before the hook sensors demand feeder action. This operates to greatly reduce, or eliminate, hysteresis.

The major sheave carriers of the compensator line storage system are made movable by crossheads subject to the force of a plurality of power cylinders. The total force balance on the crosshead is hard to manage. The crossheads are, preferably, carried by structure independent of the cylinders. The crossheads can be locked down when not needed. The lock down feature and cylinder independence improves serviceability.

BRIEF DESCRIPTION OF DRAWINGS

In the drawings wherein like features have similar captions.

DETAILED DESCRIPTION OF DRAWINGS

Figure 1:
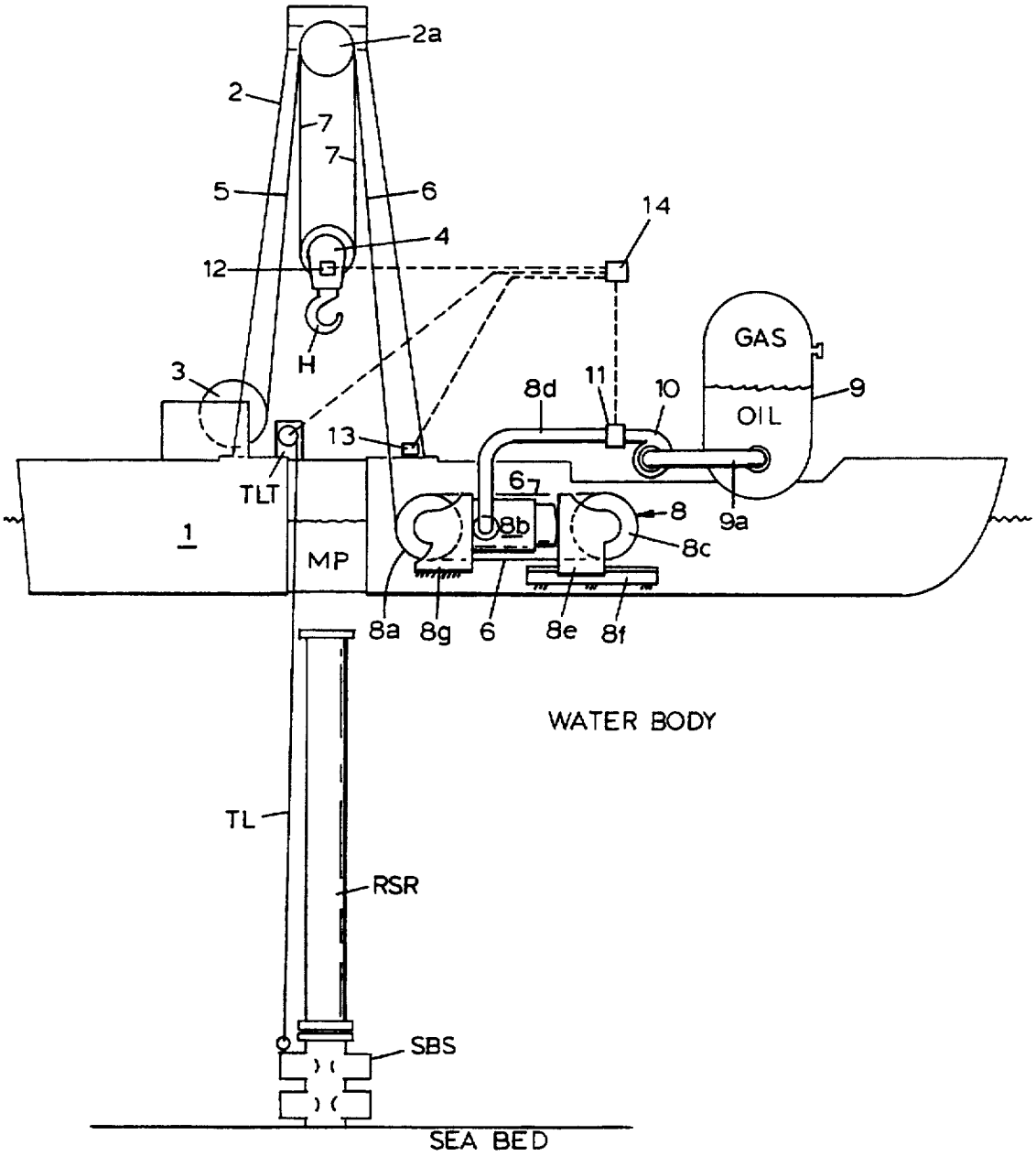
FIG. 1 is a schematic side view representing a drill ship with derrick and hoist machinery in place, situated over a sea bed well head with a schematic riser in place.

In the drawings certain features well established in the art and not bearing upon points of novelty are omitted in the interest of descriptive clarity. Such omitted features may include weld lines, bulkhead sections, some threaded fasteners, threaded joints, pins and the like.

Means to exercise four modes of operation will now be described. The first mode is simple counterbalance of the suspended load. The second mode adds a movement reverser feature by which friction is offset by a selected force. The third mode involves anticipation of an oncoming heave from recorded information and preempting the normal hysteresis lag by setting heavy machinery in motion early. The fourth mode involves use of movement sensor means on the traveling block to compensate heave and related strain in all related structure not suspended on the hook. Modes are selectable to serve the dynamic sea and hook load circumstance present. Possible mode combinations will be obvious.

In FIG. 1 a schematic of a drill ship floating on a water body above a sea bed with a well head and related riser is shown with the disclosed heave compensator, rather enlarged, situated within the vessel format. Essential support for the riser is not shown. The usual array of lines and chains between vessel and sea bed are not shown. All shown in this figure may be considered symbolic.

The vessel supports derrick 2 and the major hoist system which includes draw works 3, live line 5, crown block 2*a*, working lines 7 (which make several return loops about sheaves of crown block 2*a*), and the sheaves of traveling block 4, and dead line 6. The derrick is centered over moon pool MP.

Dead line 6 is normally clamped off to the rig structure. With this invention, the dead line is reciprocated axially to move the traveling block. To reciprocate the dead line it is spooled about sheaves of sheave sets 8*a* and 8*c* and the sheave sets are variably spaced apart by power cylinder 8*b* to provide a variable capacity line storage reservoir. The dead line is always in tension and pressure is supplied to the power cylinder by ballast tank 9. If the line reservoir is to function passively as a counterbalance to a hook loads on hook H, tube 9*a* connects to tube 8*d* and gas pressure is adjusted in tank 9 to provide tension in the dead line to balance the hook load.

If the line reservoir is to provide dead line movement to fix the position of hook H relative to the well head SBS, or riser RSR, pump 10 and its control 11 are placed between tubes 9*a* and 8*d*. The pump 10 adds to or subtracts from the ballast tank pressure presented to the cylinder 8*b*. Control 11 may be part of the pump drive and receive direction from a signal processor 14 which is connected to sensor 12 on block 4. Sensor 12 and processor 14, preferably, contain the equivalent of an inertial platform responsive to vertical acceleration. For emergency use, and suitable in many drilling circumstance, tension line TL extends from a tension line transducer TLT on the vessel to the wellhead SBS. The TLT transducer signal output goes (dashed line) to the processor 14. Instrumentation and controls are described in more detail later herein.

To control separation of sheaves 8*a* and 8*c*, of line reservoir 8, base 8*g* is attached to the vessel, crosshead 8*e* slides on ways 8*f* which are attached to the vessel, and the dead end of line 6 is clamped (not shown) to the vessel.

If the line reservoir is to serve to maintain a specific hook load for drilling as the hook moves downward, there are many instrumentation adaptations possible. The sensor 12 can include a hook load sensor similar to those now in service for that purpose. The automatic driller of the usual rig will feed off line from the draw works 3, bit by bit, to replace the bit load drilled off. The processor 14, switched to the load sensor, still controls the line reservoir 8. The automatic driller can only pay out line. Reservoir 8 works both ways. In time, the reservoir will gain line and run out of stroke if not corrected. Normal drilling feed rates are slow enough for operators to dial in corrections occasionally to keep the reservoir about mid stroke. That can be done, for instance, by stopping the automatic driller for some span of time. The reservoir will pay out its excess line as the bit weight is drilled off. Within the capacity of the line reservoir the heave compensator system will function as an excellent automatic driller.

Figure 2:
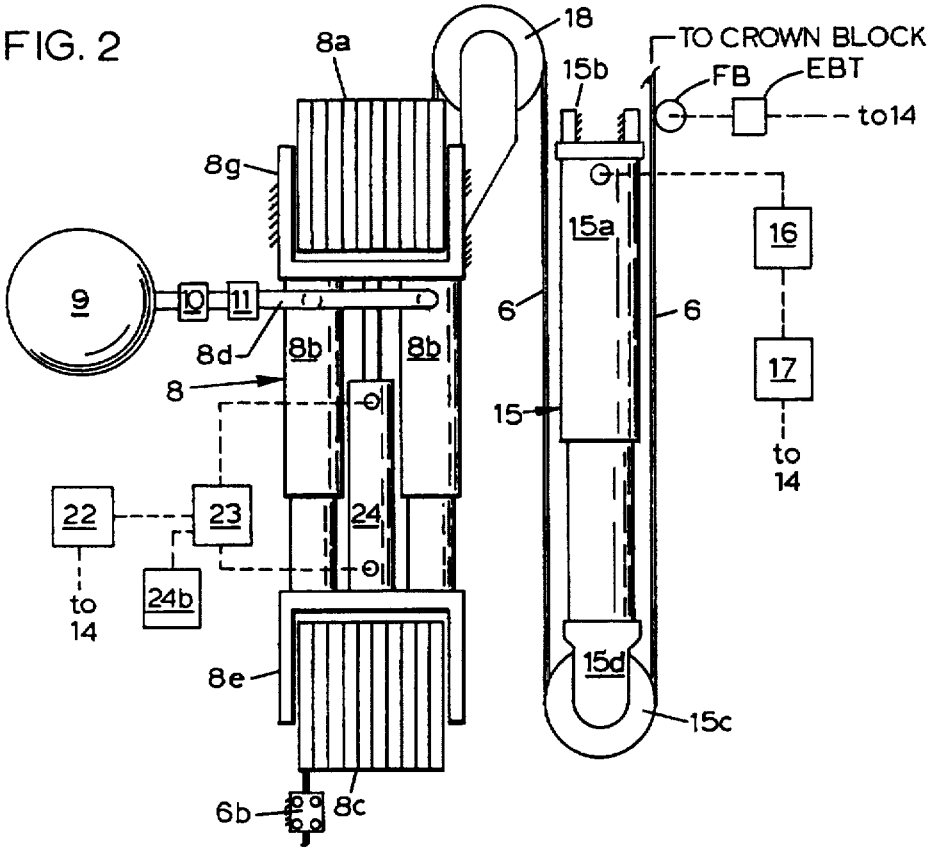
FIG. 2 is a plan view of the principal machine elements of a heave compensator line storage reservoir.

FIG. 2 is a generalized plan view of the line reservoir and alternate features that enhance and expand its capabilities. Tank 9 is seen from the top end. There are two cylinders 8*b* shown and in practice more may be used. Double acting cylinder 24 is added to the FIG. 1 concept. Cylinder 24 enables a creeper feed feature that is used in conjunction with the reverse movement anticipation that the repeating nature of swells makes attractive. When direction of movement of the vessel is about to reverse, the cylinder 24 starts the crosshead moving slowly in the direction of next compensation movement. Static friction is then absent and simple load balance may be used in more sets of circumstance. Valve 23 allows the main cylinders 8*b* to overrun the feed rate for cylinder 24 when line 6 is being rapidly fed in the planned direction. Sensor 22 (which may be sensor 13 or transducer TLT) senses cessation of vertical movement to anticipate the inevitable movement in the opposite direction and reverses control 23. Power supply 24*b* is a motor and pump arrangement.

Clamp 6*b* secures the bitter end of the dead line 6 to the vessel structure. A supply reel of new line (not shown) normally comprises the bitter end of the line 6.

As an alternate design choice, cylinder 24 can be used to provide all power needed to run line to or from the reservoir. This would eliminate the need for pump 10 on FIG. 1. The sensor 22 would replace sensor 12 and control 23 would replace control 14. Ideally, then, ballast tank 9 would just balance the hook load and the cylinder 24 system would cause all hook movement relative to the vessel to maintain its intended relationship to the sea bed reference.

Vernier system 15 is a single sheave version of line reservoir 8. Sheave 18 directs line 6 from reservoir 8 to sheave 15*c* on cross head 15*d* which is moved by cylinder 15*a* to take up line. Cylinder 15*a* has base 15*b* attached to the vessel. Hydraulic power supply 16 may derive ballast pressure from tank 9 and comprise a pump arrangement shown by either FIG. 5 or 6. Control 17 receives signal information from processor 14. The vernier feeder makes more stroke per foot of line fed and reduces localized wear on wire line when the sea conditions produce small heave excursions and short strokes of cylinders 8*b*. Additionally, when reservoir 8 is being worked hard to cope with rough seas the vernier can deliver small changes in load position when positioning suspended risers and the like.

Hoist machinery contains considerable elasticity and mass. The available power must be admitted to compensators. Safety considerations demand some feedback information during execution of commands carried out automatically. By monitoring two lines, the live line from the main hoist drum and the dead line activated by this invention, the processor can detect the instant things go wrong and correction, by choice of alternate actions programmed, by alarms, and by shutdown, can be put into action quite quickly. The line monitoring roller FB, with transducer EBT, can be used on either or both the live and the dead line. The signal output goes to processor 14. In monitoring itself, a processor can compare intent and evolving result thousands of times per second.

Figure 3:
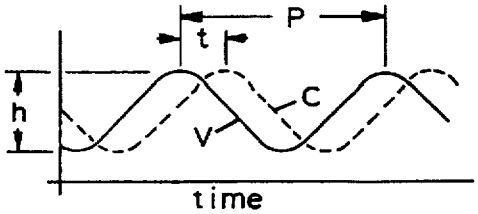
FIG. 3 is a graphic representation of a curve defining the heave movement of a vessel with an overlaid curve representing movement of the heave compensator.

FIG. 3 graphically represents time and heave amplitude h experienced by the drill ship. This is an oversimplification of the usual movement series with a time period P. The dashed curve C represents reaction of a heavy compensator with response time lag t. The reaction is subtracted from curve V to derive such things as load position change relative to a sea bed installation with the compensator fully active but not anticipating the oncoming heave. Obviously, there is a resulting net curve which will represent an undesirable load disturbance. To reduce the net curve to zero, an active compensator system has to supplement the basic counterbalance means. When compensation is perfect, the two curves coincide, and the crown block (and hook) does not move relative to earth and the traveling block, hook, and hook load contributes no inertia force to the hoist system.

Figure 4:
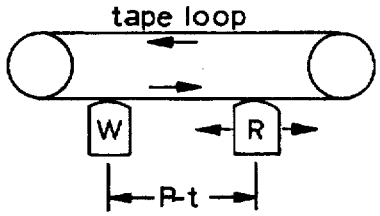
FIG. 4 represents a schematic outlay of a tape loop used to place a variable time delay between signals written on the tape by the write head and their reading off the tape by a read head.

FIG. 4 is illustrative of a classic periodic event anticipator device. This is a tape loop with write head W an adjustable distance from read head R. Head W records the value from curve V of FIG. 3 and read head R, adjustable left or right to vary the time between write and read actions, picks up the information from the moving tape which becomes the signal from which the heave compensator mechanism operates. To make curves V and C coincide, head R is placed a time related distance P-t from head W. The resulting signal from R starts the compensator machinery a time t before the heave begins on the subject vessel.

Swells change in time, primarily in amplitude, but the cause and effect in terms of write and read actions are renewed every heave period and self correction for evolving conditions is automatic. The instrument market currently supplies a solid state equivalent of the tape loop concept shown but principles involved remain much the same.

Figure 5:
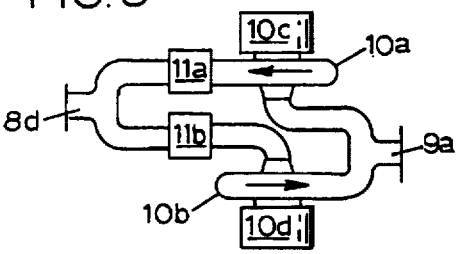
FIG. 5 is a plan view, rather enlarged, of the preferred pump installation for changing the pressure between a ballast tank and a power cylinder.

FIG. 5 shows a more detailed layout of the pump and control defined as 10 and 11 in FIG. 1. There are two identical centrifugal pumps 10*a* and 10*b* driven by motors 10*c* and 10*d* controlled by controls 11*a* and 11*b* respectively. The pumps output in opposite directions relative to tank 9 and cylinders 8*b*. Running centrifugal pumps are not harmed by flow shut off and consume less power at no flow conditions. The controls do not allow one pump to discharge into the other.

Figure 6:
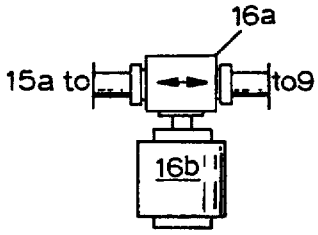
FIG. 6 is a plan view, somewhat enlarged, of a positive displacement pump arrangement for service as part of the heave compensator.

FIG. 6 shows more detail for pump 16 of FIG. 2. A positive displacement pump 16*a* is preferred here with a reversible, variable speed, motor 16*b*. This arrangement provides rather exact control of the vernier line feeding function. This same pump arrangement is preferred for use as pump 24*a* for delivering power to cylinder 24 of FIG. 2.

The preference for centrifugal pumps for pump 10 is an experience driven matter and relates to reliability. Positive displacement pumps and electric motor controls are constantly improving and the likely change of preference for the arrangement of FIG. 6 for the pump 10 is anticipated by and is within the scope of the claims.

Controls 14, 17, and 22 can be integrated into a single package with sensor selection capability and operational mode selector. The simplest mode is the counterbalance mode in which no power is provided to make the line reservoir active. That economical mode can be expected to work well for regular drilling in a reasonably calm sea. The movement reverser mode utilizes the sensor only to detect the end of a heave excursion and the processor reverses the direction of pressure increase between line reservoir and ballast tank. The applied pressure should overcome reluctance of the hoist system to move a counterbalanced load vertically relative to the vessel. The anticipator mode uses a recording of the vessel heave experienced during each swell. The recorded heave effect is delayed enough when read back to activate the lagging machinery early enough to accurately track the oncoming heave with machinery already in motion. The system is tuned in timing and amplitude to minimize the movement of the hook. The most stable mode is direct and fast response to an inertial platform on the traveling block. Response is provided by the full complement of features shown in FIG. 2, served by the pumps of FIGS. 5 and 6.

Mode compounding is anticipated, with the vernier line feeder responding to the hook mounted sensor and the main line feeder responding to the reverser mode described above. Other combinations are possible and will no doubt be practiced by operators.

All needed sub-systems are in the art, with extensive service history, and readily available for assembly into the system needed for full load heave compensation.

It will be understood that certain features and sub-combinations are of utility and may be employed without reference to other features and sub-combinations. This is contemplated by and is within the scope of the claims.

As many possible embodiments may be made of the compensator of this invention without departing from the scope thereof, it is to be understood that all matter herein set forth or shown in the accompanying drawings is to be interpreted as illustrative and not in a limiting sense.

The invention having been described, I claim:

1. A hook load counterbalance system for use on vessels supporting drilling rigs that have hoisting arrangements that incorporate a crown block, a hook supported by traveling block, and a dead line extending from the crown block to a clamp on the base of the derrick, the counterbalance system comprising:

a) line storage means mounted on the vessel and comprising two sets of wire line sheaves, the sets variably separated in a direction perpendicular to the axis of rotation of said sheaves by movement of at least one power cylinder, the stored line secured to the vessel on one end, executing a plurality of loops about said sheaves such that increasing said spacing requires more line, and continuing from the storage means as said dead line for said wire line working system;

b) a ballast tank to contain a pressurized fluid with communication channels connecting said tank and said cylinder such that said pressure tends to increase said separation;

c) at least one second cylinder, with an associated hydraulic power supply, responsive to signals indicative of the direction of vertical movement of said vessel, to provide at least static friction breaking separation movement to provide compensation for vessel movement in said direction.

2. The counterbalance of claim 1 wherein a fluid pump is provided in said channel to change said pressure delivered to said cylinder.

3. The counterbalance of claim 2 wherein said pump is responsive to signals provided by an external sensor to change direction of said change.

4. The counterbalance of claim 1 wherein said ballast tank comprises a hydraulic accumulator with a pressure equalizing separator between gas and liquid, said channel connected to communicate said liquid.

5. A heave compensator system for use on floating structures supporting drilling rigs that manipulate hoist hook loads by means that utilizes a crown block, a hook supported by a traveling block, and a wire line working system including a live line and a dead line to control the vertical position of the hook, the compensator influencing the hook position by varying the amount of dead line stored by the compensator, the system comprising:

a) line storage means mounted on the vessel and comprising two sets of wire line sheaves, the sets variably separated in a direction perpendicular to the axis of rotation of said sheaves by movement of at least one power cylinder, the stored line secured to the vessel on one end, executing a plurality of loops about said sheaves such that increasing said spacing requires more line, and continuing from the storage means as said dead line for said wire line working system;

b) a ballast pressure gas over liquid storage system comprising at least on tank with provisions to change gas pressure and liquid volume therein with at least one duct arranged to conduct said liquid between said tank and said cylinder and connected thereto such that pressure in said tank tends to urge said sheave sets farther apart;

c) ballast pressure augmenting pump means in said duct, responsive to signals from a direction of heave movement sensor, arranged to add a preselected amount of pressure in a preselected direction to said liquid to urge movement of said dead line to compensate said hook for heave in said direction.

6. A heave compensator system for use on floating structures supporting drilling rigs that manipulate hoist hook loads by means that utilizes a crown block, hook supporting traveling block, and a wire line working system including a live line and a dead line to control the vertical position of the hook, the compensator influencing the hook load by varying the amount of dead line stored by the compensator, the system comprising:

a) line storage means mounted on the vessel and comprising two sets of wire line sheaves, the sets variably separated in a direction perpendicular to the axis of rotation of said sheaves by movement of at least one power cylinder, the stored line secured to the vessel on one end, executing a plurality of loops about said sheaves such that increasing said spacing requires more line, and continuing from the storage means as said dead line for said wire line working system;

b) a ballast pressure storage system comprising at least on tank, with an equalizing separator between gas and liquid volumes, with provisions to change gas pressure and liquid volume therein with at least one duct arranged to conduct said liquid between said tank and said cylinder and connected thereto such that pressure in said tank tends to urge said sheave sets farther apart;

c) sensor means arranged to sense movement of said floating structure and to produce a signal indicative of actions required of said dead line reservoir to move said dead line to compensate for said movement;

d) ballast augmenting pump means fluidly connected to said duct arranged to add pressure to said liquid in a preselected amount and direction, in response to said signals from said sensor, to change the amount of said dead line stored in said line storage means.

7. The compensator of claim 6 wherein said sensor stores heave related information for delayed recovery to anticipate upcoming heave movements to provide said signal with a timing factor to offset hysteresis lag of at least said compensator.

8. A heave compensator system for use on floating structures supporting drilling rigs that manipulate hoist hook loads by means that utilizes a crown block, a hook supporting traveling block, and a wire line working system including a live line and a dead line to control the vertical position of the hook, the compensator influencing the hook position by varying the amount of dead line stored by the compensator, the system comprising:

a) line storage means mounted on the vessel and comprising two sets of wire line sheaves, the sets variably separated in a direction perpendicular to the axis of rotation of said sheaves by movement of at least one power cylinder, the stored line secured to the vessel on one end, executing a plurality of loops about said sheaves such that increasing said spacing requires more line, and continuing from the storage means as said dead line for said wire line working system;

b) a ballast pressure gas over liquid storage system comprising at least one tank with provisions to change gas pressure and liquid volume therein, with at least one duct arranged to conduct said liquid between said tank and said cylinder and connected thereto such that pressure in said tank tends to urge said sheave sets farther apart;

c) sensor means arranged to sense movement of said vessel relative to earth and to produce a signal indicative of change of vertical direction of said movement;

d) at least one second power cylinder with an associated hydraulic power supply, responsive to said signal, situated to urges change in said separation of said sheave sets in a direction to reduce friction losses when said vessel moves and said wire line working system is set in motion.

9. The compensator of claim 8 wherein said dead line storage means is divided into independent first and second line storage means, said first line storage means having a greater line storage to cylinder movement ratio than said second line storage means, both line storage means situated in series along said dead line.

10. The compensator of claim 8 wherein said sensor stores heave related information for delayed recovery to anticipate upcoming heave movements to provide said signal with a timing factor to offset hysteresis lag of at least said compensator.

11. A heave compensator system for use on floating structures supporting drilling rigs that manipulate hoist hook loads by means that utilizes a crown block, traveling block, and a wire line working system including a live line and a dead line to control the vertical position of the hook, the compensator to influence the hook position by varying the amount of dead line stored by the compensator, the system comprising:

a) line storage means mounted on the vessel and comprising two sets of wire line sheaves, the sets variably separated in a direction perpendicular to the axis of rotation of said sheaves by movement of at least one power cylinder, the stored line secured to the vessel on one end, executing a plurality of loops about said sheaves such that increasing said spacing requires more line, and continuing from the storage means as said dead line for said wire line working system;

b) a ballast pressure storage system comprising at least one tank with an equalizing separator between gas and liquid volumes with provisions to change gas pressure and liquid volume therein with at least one duct arranged to conduct said liquid between said tank and said cylinder and connected thereto such that pressure in said tank tends to urge said sheave sets farther apart;

c) accelerator sensor means carried by said traveling block, arranged to sense acceleration of said traveling block and to produce a signal indicative of actions required of said dead line storage means to move said dead line to compensate for movement resulting from said acceleration;

d) pump means in said duct arranged to add pressure to said liquid in said duct in a preselected amount and direction, in response to said signals, to change the amount of said dead line stored on said dead line storage means.

12. The compensator of claim 11 wherein said dead line storage means is divided into independent first and second said line storage means, said first line storage means having a smaller line storage change to cylinder movement ratio than said second line storage means, both said line storage means situated in series along said dead line.

13. The compensator system of claim 11 wherein said sensor is an inertial platform active in sensing at least the vertical movement of said traveling block.

14. The compensator of claim 13 wherein said signal comprises at least three components; acceleration, velocity, and distance moved relative to preselected references.

15. The compensator of claim 14 wherein said dead line storage means is divided into independent first and second line storage means, said first line storage means having a smaller line storage change to cylinder movement ratio than said second line storage means, an independent hydraulic power supply and control responsive to said signal, both line storage means situated in series along said dead line.

16. The compensator of claim 13 wherein said sensor is associated with signal processor means to produce said signal as corrective action directives to cancel the block acceleration, cancel block velocity and then to move said block back to the starting point indicated by said distance moved.

17. A heave compensator system for use on floating structures supporting drilling rigs that manipulate hoist hook loads by means that utilizes a crown block, traveling block, and a wire line working system including a live line and a dead line to control the vertical position of the hook, the compensator to influence the hook position by varying the amount of dead line stored by the compensator, the system comprising:

a) line storage means mounted on the vessel and comprising two sets of wire line sheaves, the sets variably separated in a direction perpendicular to the axis of rotation of said sheaves by movement of at least one first power cylinder, the stored line secured to the vessel on one end, executing a plurality of loops about said sheaves such that increasing said spacing requires more line, and continuing from the storage means as said dead line for said wire line working system;

b) a ballast pressure gas over liquid storage system comprising at least one tank with provisions to change gas pressure and liquid volume therein with at least one duct arranged to conduct said liquid between said tank and said cylinder and connected thereto such that pressure in said tank tends to urge said sheave sets farther apart;

c) sensor means carried by said traveling block, arranged to sense movement of said traveling block relative to earth and to produce a signal indicative of actions required of said dead line reservoir to move said dead line to compensate for said movement;

d) at least one second power cylinder arranged to assist said first power cylinder, with associated hydraulic power source and control, responsive to said signal, to urge said line storage means to move to perform said actions required.

18. The compensator system of claim 17 wherein said sensor is an inertial platform active in sensing at least the vertical movement of said traveling block.

19. The compensator of claim 18 wherein said signal comprises at least three components; acceleration, velocity, and distance moved relative to preselected references.

20. The compensator of claim 18 wherein said sensor is associated with signal processor means to produce said signal as corrective action directives to cancel the block acceleration, cancel block velocity and then to move said block back to the starting point indicated by said distance moved.

21. A heave compensator control system for drilling rigs on floating vessels with a main hoist system having a live line, crown block, and a hook carried by a traveling block to maintain the hook vertically generally stationary relative to earth when the vessel heaves, the control comprising:

a) means to move said hook relative to said vessel in response to signals from a hook movement sensor;

b) said hook movement sensor means comprising an acceleration sensing means and associated circuitry mounted on structure that moves with said hook to detect movement of said hook and to produce signals indicative of actions required of said means to move to control said hook position relative to earth, said produced signals comprising factors related to at least acceleration, velocity, and displacement relative to earth.

22. A heave compensator control system for drilling rigs on floating vessels having a main hoist system with a live line, a crown block, a hook carried by a traveling block and a dead line to maintain the hook vertically generally stationary relative to earth when the vessel heaves, the control comprising:

a) means to move said hook relative to said vessel in response to signals from a vessel vertical movement sensor;

b) said movement sensor means comprising an acceleration sensing means and associated circuitry mounted on structure that moves with said vessel to detect movement of said vessel relative to earth and to produce signals indicative of actions required of said means to move to maintain said hook in a preselected position relative to earth, said produced signals comprising factors related to at least acceleration, velocity, and displacement relative to earth.

23. A heave compensator control system for drilling rigs on floating vessels, the rigs having a main hoist system with a live line, a crown block, a hook carried by a traveling block and a dead line, to maintain the hook vertically generally stationary relative to earth when the vessel heaves, the control comprising:

a) means to move said hook relative to said vessel in response to signals from a ship movement sensor;

b) said ship movement sensor means comprising an acceleration sensing means and associated circuitry mounted on structure that moves with said vessel to detect movement of said vessel relative to earth and to produce signals indicative of actions required of said means to move to maintain said hook in a preselected position relative to earth, said produced signals comprising factors related to at least acceleration, velocity, and displacement relative to earth;

c) delay means to store said produced signals a preselected amount of time before delivery of said produced signals to said means to move.

* * * * *